US009265344B2

(12) United States Patent
Chen et al.

(10) Patent No.: US 9,265,344 B2
(45) Date of Patent: Feb. 23, 2016

(54) ADJUSTING DEVICE

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Shih-Lung Huang, Kaohsiung (TW); Chien-Hung Kuo, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 0 days.

(21) Appl. No.: 14/803,198

(22) Filed: Jul. 20, 2015

(65) Prior Publication Data

US 2015/0320211 A1 Nov. 12, 2015

Related U.S. Application Data

(63) Continuation of application No. 14/247,367, filed on Apr. 8, 2014.

(51) Int. Cl.

| | |
|---|---|
| ***A47B 96/14*** | (2006.01) |
| ***A47B 88/00*** | (2006.01) |
| ***A47B 88/04*** | (2006.01) |
| ***A47B 96/06*** | (2006.01) |
| ***A47B 96/07*** | (2006.01) |
| ***A47B 96/20*** | (2006.01) |

(52) U.S. Cl.

CPC ..... *A47B 88/0055* (2013.01); *A47B 88/0085* (2013.01); *A47B 88/04* (2013.01); *A47B 96/06* (2013.01); *A47B 96/07* (2013.01); *A47B 96/14* (2013.01); *A47B 96/20* (2013.01); *Y10T 403/46* (2015.01)

(58) Field of Classification Search

CPC .... A47B 88/00; A47B 88/04; A47B 88/0044; A47B 88/0051; A47B 88/0055; A47B 88/0085; A47B 2088/0062; A47B 96/06; A47B 96/07; A47B 96/14; A47B 96/20

USPC ..... 312/330.1, 348.1, 348.4; 248/274.1

See application file for complete search history.

(56) References Cited

U.S. PATENT DOCUMENTS 4,995,683 A * 2/1991 Albiez ..... A47B 88/0055 312/348.4
5,664,857 A * 9/1997 Lautenschlager .. A47B 88/0051 312/330.1

(Continued)

FOREIGN PATENT DOCUMENTS

WO WO 2012068599 * 5/2012

*Primary Examiner* — James O Hansen
(74) *Attorney, Agent, or Firm* — Rosenberg, Klein & Lee

(57) ABSTRACT

An adjusting device includes a fixed member; first and second plates, both connected to the fixed member; a first adjusting member; and a first locking member. The fixed member has a first hole and a window. The second plate has first and second contact portions. The first adjusting member has an adjusting portion contacting against the second contact portion and has an eccentric portion extending through the window and movably connected to the first plate. The first locking member partially extends through the first contact portion and the first hole to connect with the first plate. The second plate can be displaced relative to the fixed member in response to displacement of the first adjusting member.

18 Claims, 9 Drawing Sheets

(56) References Cited

U.S. PATENT DOCUMENTS

| | | | | |
|---|---|---|---|---|
| 6,027,194 | A * | 2/2000 | Fleisch | A47B 88/0055 312/348.1 |
| 6,390,576 | B1 | 5/2002 | Walburn | |
| 7,429,090 | B2 * | 9/2008 | Salice | A47B 88/0055 312/348.4 |
| 7,625,051 | B1 | 12/2009 | Kim | |
| 8,215,730 | B2 * | 7/2012 | Brown | A47B 88/0055 312/348.4 |
| 8,262,175 | B2 * | 9/2012 | Lam | A47B 88/0055 312/348.4 |
| 2009/0174299 | A1 * | 7/2009 | Lam | A47B 88/0055 312/348.4 |
| 2013/0257252 | A1 * | 10/2013 | Holzapfel | A47B 88/0055 312/348.4 |

* cited by examiner

ADJUSTING DEVICE

CROSS-REFERENCE TO RELATED APPLICATIONS

This application is a continuation of U.S. patent application Ser. No. 14/247,367, filed Apr. 8, 2014, currently pending.

FIELD OF THE INVENTION

The present invention relates to an adjusting device and more particularly to an adjusting device applicable to a furniture system to facilitate the adjustment of the angle and/or position of a drawer face panel relative to a drawer housing.

BACKGROUND OF THE INVENTION

FIG. 1 shows a drawer system 2 which includes a drawer housing 4 and a plurality of drawers 6*a*, 6*b*, 6*c*. Generally, a pair of slide rail assemblies is mounted between each drawer 6*a*, 6*b*, 6*c* and the drawer housing 4 so that each drawer 6*a*, 6*b*, 6*c* can be easily pulled out from or pushed into the drawer housing 4 by means of the corresponding slide rail assembly.

However, should the assembly tolerance of any component of the drawer system (i.e., the drawer housing 4, any of the drawers 6*a*, 6*b*, 6*c*, or any of the slide rail assemblies) be too great, or should the components be improperly assembled, or should the assembly quality be otherwise impaired, the drawers 6*a*, 6*b*, 6*c* may become tilted and have problem in fitting snugly into the drawer housing 4. In FIG. 1, the drawers 6*a* and 6*b* are in an abnormal condition in which the two drawers are obliquely positioned and form an angle θ1 and an angle θ2 with the drawer housing 4 respectively. The drawer 6*c*, on the other hand, is in a normal condition.

U.S. Pat. No. 6,390,576 B1, granted to Walburn, discloses a drawer face panel which is adjustable with respect to a drawer slide and whose position, therefore, can be adjusted relative to the drawer housing. The adjusting means of the '576 patent is implemented by the user manually supporting the drawer face panel and then fixing the drawer face panel in position with screws. As the user is required to hold the drawer face panel with a hand, the adjusting means is physically demanding and leaves something to be desired.

SUMMARY OF THE INVENTION

The present invention relates to an adjusting device applicable to a slide rail assembly to facilitate the adjustment of the angle and/or position of a drawer face panel relative to a drawer housing.

According to one aspect of the present invention, an adjusting device includes: a fixed member which includes a first face portion, a second face portion opposite the first face portion, a first hole, and a window; a first plate which is connected to the first face portion of the fixed member, the first plate having a first axial portion corresponding in position to the window of the fixed member; a second plate which is connected to the second face portion of the fixed member, the second plate having a first contact portion and a second contact portion, wherein the first contact portion corresponds in position to the first hole of the fixed member, and the second contact portion corresponds in position to the window of the fixed member; a first adjusting member which includes an adjusting portion and an eccentric portion connected to the adjusting portion, the adjusting portion contacting against the second contact portion of the second plate, the eccentric portion extending through the window of the fixed member and being movably connected to the first axial portion of the first plate; and a first locking member which has a portion extending sequentially through the first contact portion of the second plate and the first hole of the fixed member and connected to the first plate. The second plate is displaceable relative to the fixed member in response to displacement of the first adjusting member.

Preferably, the adjusting device further includes a second adjusting member connected to the fixed member and the first plate, the fixed member has a longitudinal hole, and the first plate has a second axial portion. The second adjusting member includes an adjusting portion and an eccentric portion connected to the adjusting portion. The adjusting portion of the second adjusting member contacts against a hole wall of the longitudinal hole of the fixed member. The eccentric portion of the second adjusting member is movably connected to the second axial portion of the first plate. The first plate is displaceable relative to the fixed member in response to displacement of the second adjusting member so as to displace the first locking member relative to the fixed member, and the second plate is displaceable relative to the fixed member in response to displacement of the first locking member.

Preferably, the first plate has a pair of first transverse holes. By passing a pair of first connecting elements through the pair of first transverse holes respectively, the first plate is connected to the fixed member in such a way that the first plate is transversely displaceable relative to the fixed member.

Preferably, the first plate has a pair of second transverse holes. By passing a pair of second connecting elements through the pair of second transverse holes respectively, the first plate is connected to the fixed member in such a way that the first plate is transversely displaceable relative to the fixed member.

Preferably, the fixed member has a second hole, and the second plate has a connecting portion corresponding in position to the second hole of the fixed member. The connecting portion has a first sidewall and a second sidewall. The first sidewall and the second sidewall are spaced apart by a predetermined distance. The first plate and the second plate are locked to the fixed member by a second locking member, which has a portion extending sequentially through the connecting portion of the second plate and the second hole of the fixed member and connected to the first plate.

Preferably, the second plate has a first plate section and a second plate section substantially perpendicularly connected to the first plate section. The first contact portion and the second contact portion are provided by the first plate section.

Preferably, the second hole of the fixed member has a first width and a first height, and the connecting portion of the second plate has a second width and a second height. The first width of the second hole is greater than or equal to the second width of the connecting portion of the second plate. The first height of the second hole is greater than the second height of the connecting portion of the second plate.

According to another aspect of the present invention, an adjusting device applicable to a furniture system is provided, wherein the furniture system includes a drawer housing, a drawer face panel, and a slide rail assembly. The slide rail assembly at least includes a fixed rail and a movable rail slidable relative to the fixed rail. The fixed rail is fixedly mounted to the drawer housing. The adjusting device includes: a fixed member fixedly mounted to the movable rail of the slide rail assembly, the fixed member including a first hole and a window; a first plate connected to the fixed member, the first plate having a first axial portion corresponding in position to the window of the fixed member; a second plate connected to the fixed member, the second plate having a first plate section and a second plate section substantially perpendicularly connected to the first plate section, the drawer face panel being mounted to the second plate section, the first plate section having a first contact portion and a second contact portion, wherein the first contact portion corresponds in position to the first hole of the fixed member, and the second contact portion corresponds in position to the window of the fixed member; a first adjusting member including an adjusting portion and an eccentric portion connected to the adjusting portion, wherein the adjusting portion contacts against the second contact portion of the second plate, and the eccentric portion extends through the window of the fixed member and is movably connected to the first axial portion of the first plate; and a first locking member having a portion which extends sequentially through the first contact portion of the second plate and the first hole of the fixed member and is connected to the first plate. The second plate is angularly adjustable relative to the fixed member in response to displacement of the first adjusting member such that the drawer face panel is angularly adjustable relative to the drawer housing.

BRIEF DESCRIPTION OF THE DRAWINGS

The invention as well as a preferred mode of use and the advantages thereof will be best understood by referring to the following detailed description of some illustrative embodiments in conjunction with the accompanying drawings, wherein.

DETAILED DESCRIPTION OF THE INVENTION

Figure 1:
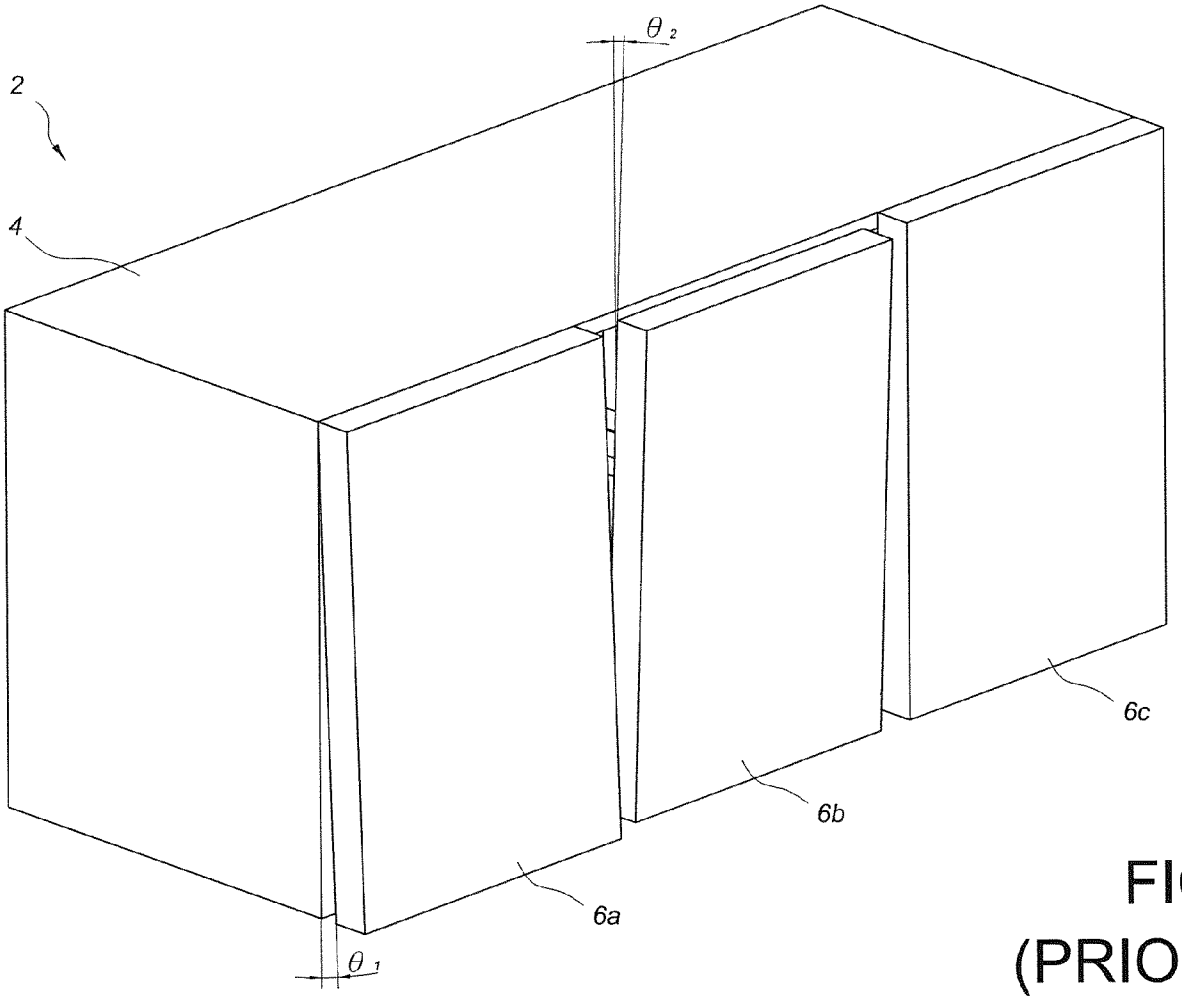
FIG. 1 (PRIOR ART)
FIG. 1 is a perspective view of a conventional drawer system.
Figures 2A, 2B:
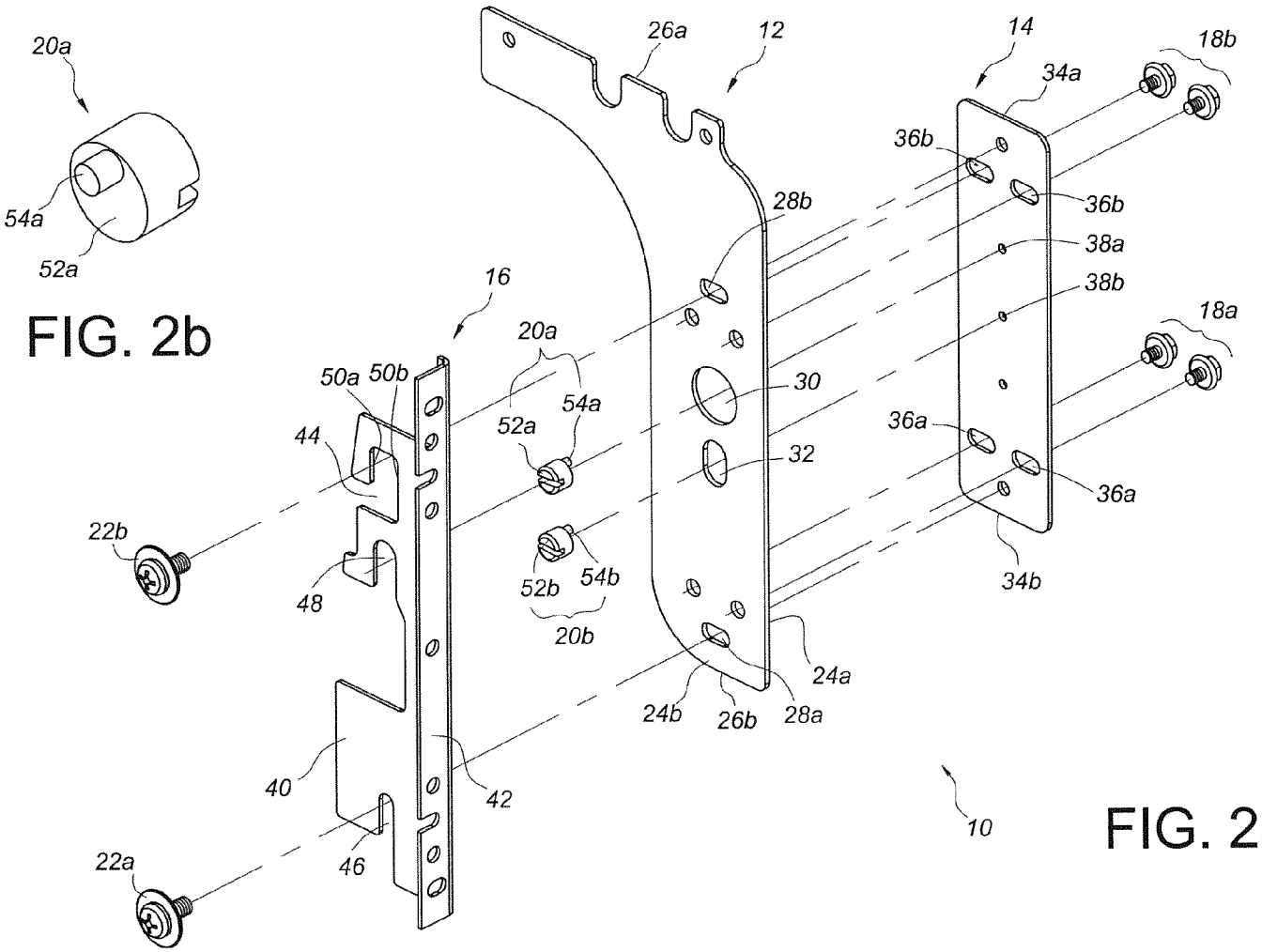
FIG. 2*a* is an exploded perspective view of the adjusting device in an embodiment of the present invention.
FIG. 2*b* is a perspective view of the first adjusting member in the foregoing embodiment.
Figure 3:
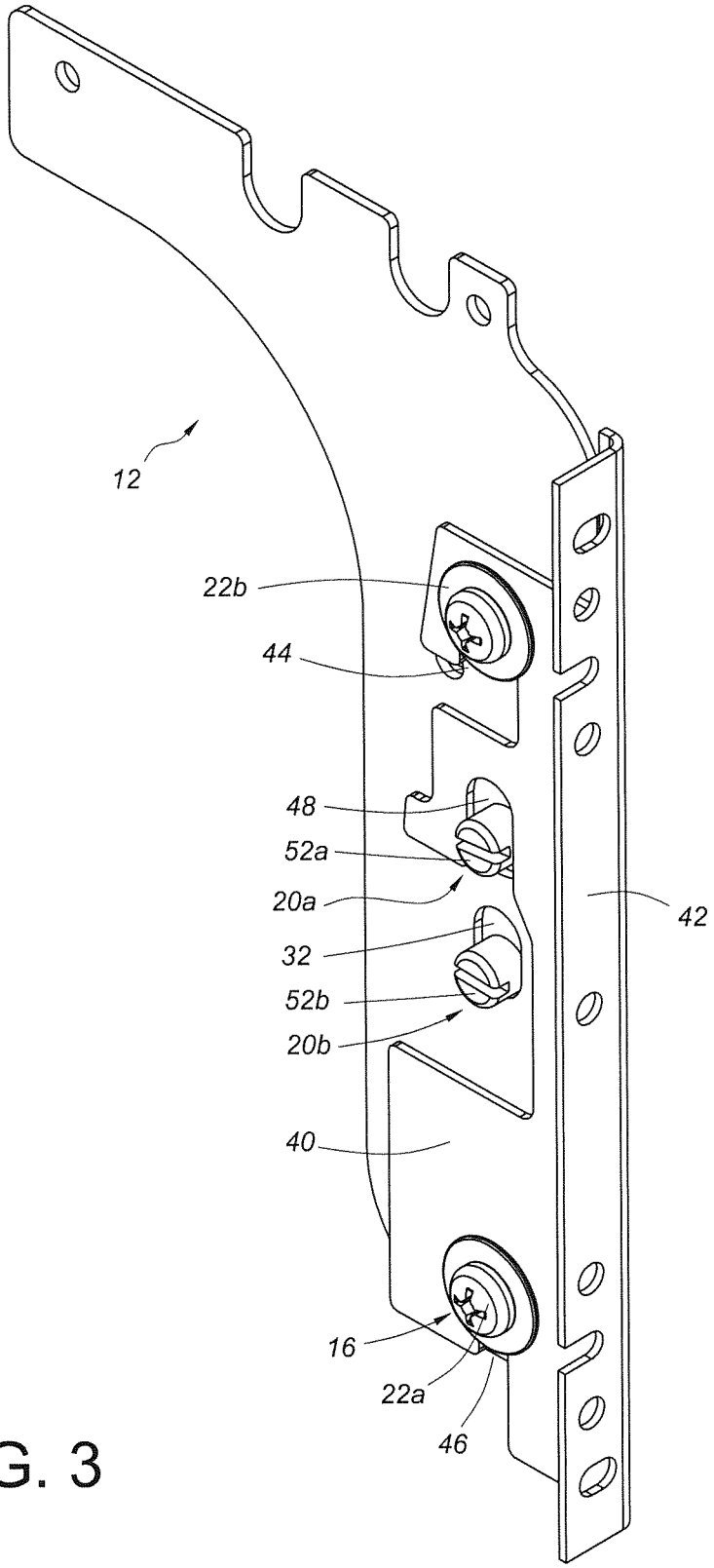
FIG. 3 is an assembled perspective view of the adjusting device in an embodiment of the present invention.

FIG. 2*a*, FIG. 2*b*, and FIG. 3 illustrate the adjusting device 10 in a preferred embodiment of the present invention. The adjusting device 10 includes a fixed member 12, a first plate 14, a second plate 16, a pair of first connecting elements 18*a*, a pair of second connecting elements 18*b*, a first adjusting member 20*a*, a second adjusting member 20*b*, a first locking member 22*a*, and a second locking member 22*b*.

The fixed member 12 includes a first face portion 24*a*, a second face portion 24*b* opposite the first face portion 24*a*, a top edge 26*a*, a bottom edge 26*b*, a first hole 28*a* adjacent to the bottom edge 26*b*, a second hole 28*b* adjacent to the top edge 26*a*, a window 30, and a longitudinal hole 32. The window 30 and the longitudinal hole 32 are located between the first hole 28*a* and the second hole 28*b*. Preferably, the first hole 28*a* and the second hole 28*b* are transverse holes.

The first plate 14 is connected to the first face portion 24*a* of the fixed member 12. The first plate 14 includes a top edge 34*a*, a bottom edge 34*b*, a pair of first transverse holes 36*a* adjacent to the bottom edge 34*b*, a pair of second transverse holes 36*b* adjacent to the top edge 34*a*, a first axial portion 38*a*, and a second axial portion 38*b*. The first axial portion 38*a* and the second axial portion 38*b* are located between the pair of first transverse holes 36*a* and the pair of second transverse holes 36*b*. The first axial portion 38*a* corresponds in position to the window 30 of the fixed member 12. The second axial portion 38*b* corresponds in position to the longitudinal hole 32 of the fixed member 12.

The second plate 16 is connected to the second face portion 24*b* of the fixed member 12. The second plate 16 has a first plate section 40 and a second plate section 42 substantially perpendicularly connected to the first plate section 40. The first plate section 40 has a connecting portion 44, a first contact portion 46, and a second contact portion 48 located between the connecting portion 44 and the first contact portion 46. The connecting portion 44 corresponds in position to the second hole 28*b* of the fixed member 12. Moreover, the connecting portion 44 has a first sidewall 50*a* and a second sidewall 50*b*. The first sidewall 50*a* and the second sidewall 50*b* are spaced apart by a predetermined distance. The first contact portion 46 corresponds in position to the first hole 28*a* of the fixed member 12. The second contact portion 48 corresponds in position to the window 30 of the fixed member 12. In one preferred embodiment, the connecting portion 44, the first contact portion 46, and the second contact portion 48 are all hook-shaped; however, the configurations of these three portions are not limited to such a shape.

The pair of first connecting elements 18*a* corresponds in position to the pair of first transverse holes 36*a* of the first plate 14 respectively. Each of the first connecting elements 18*a* has a portion extending through one of the first transverse holes 36*a* so as to connect the first plate 14 to the fixed member 12. Similarly, the pair of second connecting elements 18*b* corresponds in position to the pair of second transverse holes 36*b* of the first plate 14 respectively. Each of the second connecting elements 18*b* has a portion extending through one of the second transverse holes 36*b* so as to connect the first plate 14 to the fixed member 12. Thus, the first plate 14 is rendered transversely displaceable relative to the fixed member 12.

The first adjusting member 20*a* includes an adjusting portion 52*a* and an eccentric portion 54*a* connected to the adjusting portion 52*a*. The adjusting portion 52*a* of the first adjusting member 20*a* contacts against the second contact portion 48 of the first plate section 40 of the second plate 16. The eccentric portion 54*a* of the first adjusting member 20*a* extends through the window 30 of the fixed member 12 and is movably connected to the first axial portion 38*a* of the first plate 14.

The second adjusting member 20*b* is configured in the same way as the first adjusting member 20*a*. The second adjusting member 20*b* includes an adjusting portion 52*b* and an eccentric portion 54*b* connected to the adjusting portion 52*b*. The adjusting portion 52*b* of the second adjusting member 20*b* contacts against the hole wall of the longitudinal hole 32 of the fixed member 12. The eccentric portion 54*b* of the second adjusting member 20*b* is movably connected to the second axial portion 38*b* of the first plate 14.

The first locking member 22*a* has a portion which, after extending through the first contact portion 46 of the second plate 16 and then through the first hole 28*a* of the fixed member 12, is connected to the first plate 14 to lock the first plate 14 and the second plate 16 to the fixed member 12.

The second locking member 22*b* has a portion extending sequentially through the connecting portion 44 of the second plate 16 and the second hole 28*b* of the fixed member 12 and connected to the first plate 14 to lock the first plate 14 and the second plate 16 to the fixed member 12.

When the first locking member 22*a* and the second locking member 22*b* are fastened, the first plate 14 and the second plate 16 are fixed to the fixed member 12. Once the first locking member 22*a* and the second locking member 22*b* are unfastened, the first plate 14 and the second plate 16 can be displaced relative to the fixed member 12.

Figures 2C, 2D:
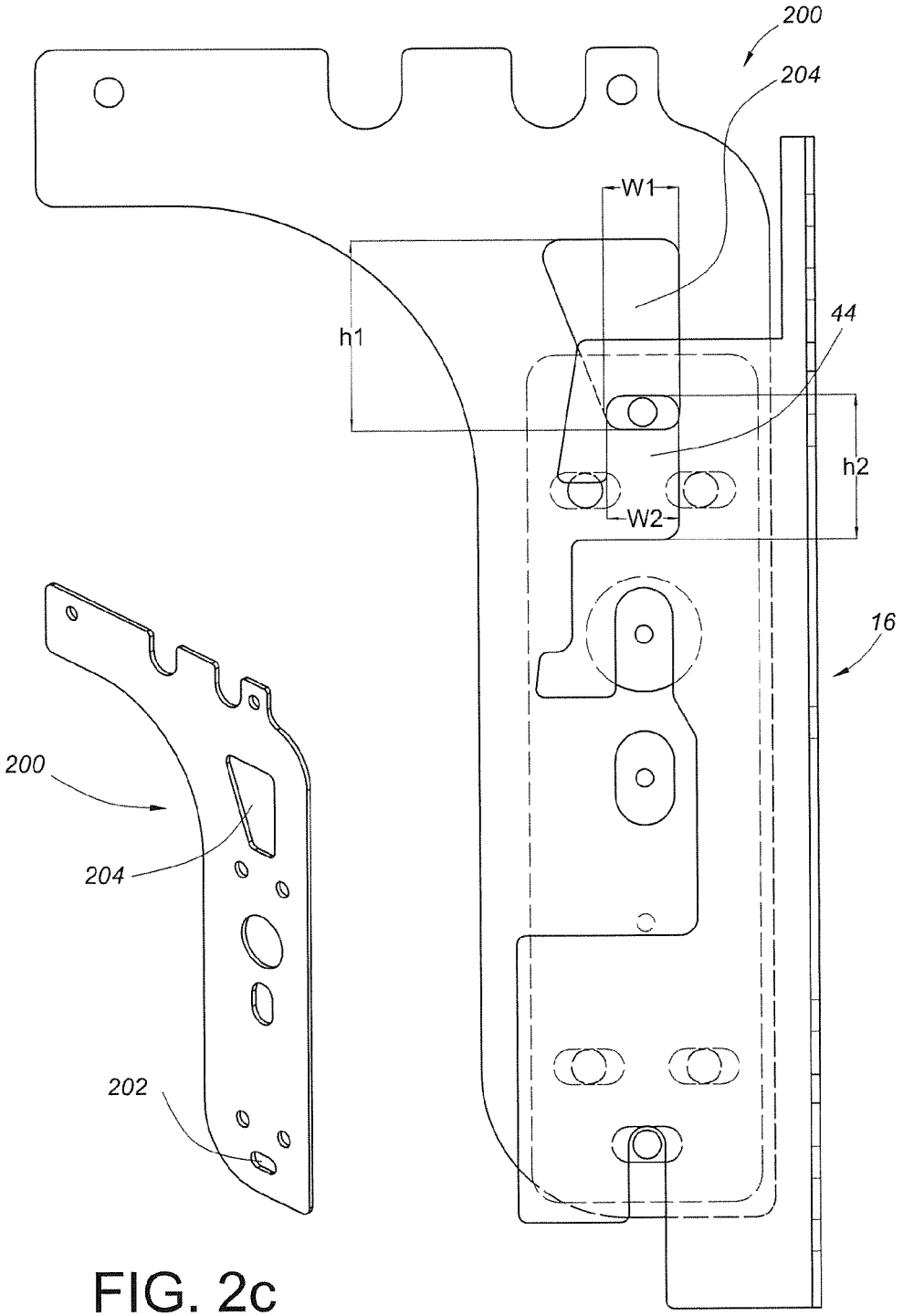
FIG. 2*c* is a perspective view of the fixed member in another embodiment of the present invention.
FIG. 2*d* schematically shows the relationship between the fixed member and the second plate in the embodiment in FIG. 2*c;*

FIG. 2*c* shows the fixed member 200 in another embodiment of the present invention. The fixed member 200 is similar in configuration to the fixed member 12. The fixed member 200 has a first hole 202 and a second hole 204. While the first hole 202 is identical to the first hole 28*a* of the fixed member 12, the second hole 204 is larger than the second hole 28*b* of the fixed member 12 to make it easier for the second locking member 22*b* to extend sequentially through the connecting portion 44 of the second plate 16 and the second hole 204 and connect with the first plate 14.

As shown in FIG. 2*d*, the second hole 204 of the fixed member 200 has a first width w1 and a first height h1, and the connecting portion 44 of the second plate 16 has a second width w2 and a second height h2. The first width w1 of the second hole 204 of the fixed member 200 is greater than or equal to the second width w2 of the connecting portion 44 of the second plate 16. The first height h1 of the second hole 204 of the fixed member 200 is greater than the second height h2 of the connecting portion 44 of the second plate 16.

Figure 4C:
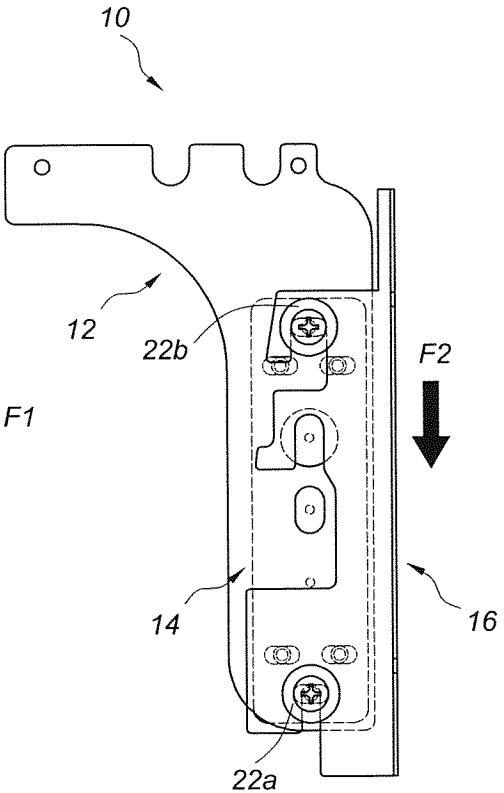
FIG. 4*c* schematically shows how the adjusting device in FIG. 4*b* is further assembled.
Figure 4B:
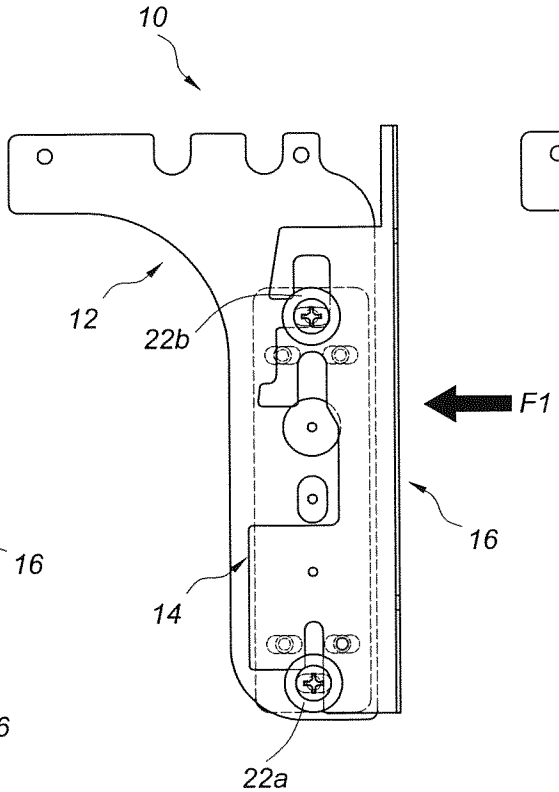
FIG. 4*b* schematically shows how the adjusting device in FIG. 4*a* is further assembled.
Figure 4A:
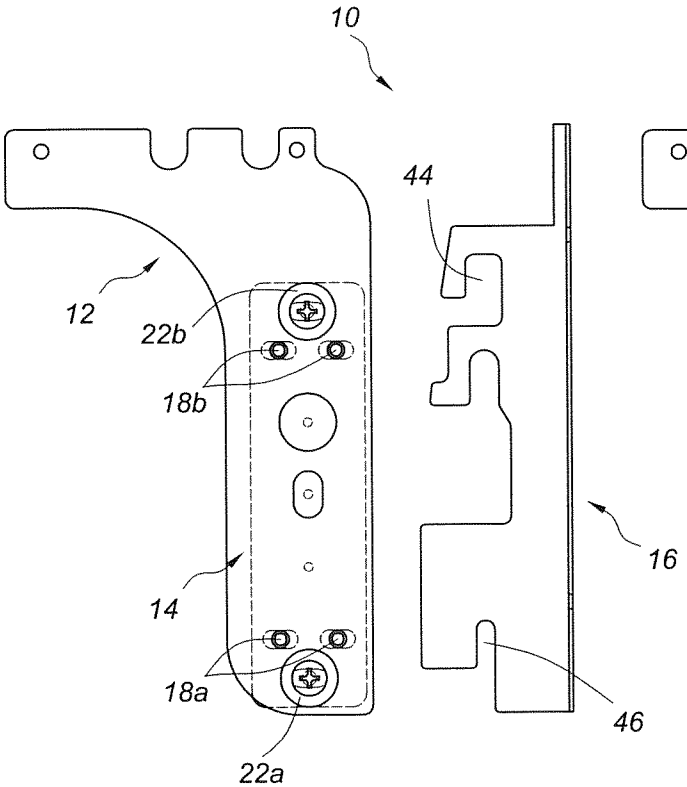
FIG. 4*a* schematically shows how the adjusting device in an embodiment of the present invention is assembled.

In FIG. 4*a*, the first plate 14 is connected to the fixed member 12 by the pair of first connecting elements 18*a* and the pair of second connecting elements 18*b*. In addition, the fixed member 12 and the first plate 14 are connected by the first locking member 22*a* and the second locking member 22*b*. To put the second plate 16 in place, the connecting portion 44 and the first contact portion 46 of the second plate 16 are respectively brought to the second locking member 22*b* and the first locking member 22*a* from the lateral side. As shown in FIG. 4*b*, the second plate 16 is moved in the direction F1 so that the connecting portion 44 and the first contact portion 46 are located above the second locking member 22*b* and the first locking member 22*a* respectively. Then, in FIG. 4*c*, the second plate 16 is moved in the direction F2 due to its own weight and is thus movably mounted to the fixed member 12.

Figure 5B:
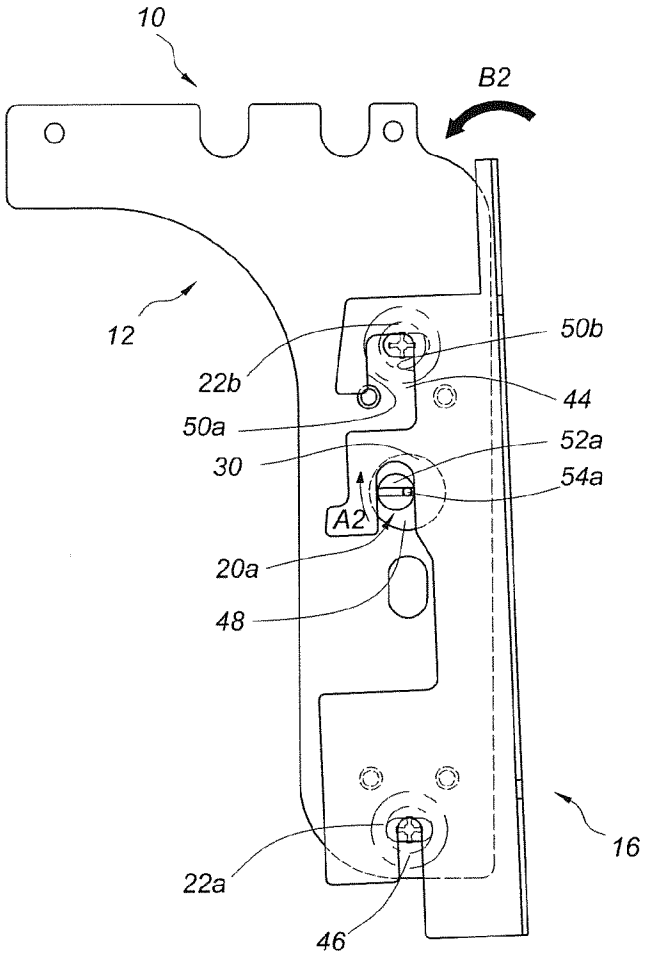
FIG. 5*b* is a schematic drawing in which the adjusting device in the embodiment in FIG. 5*a* has been adjusted by a second angle.
Figure 5A:
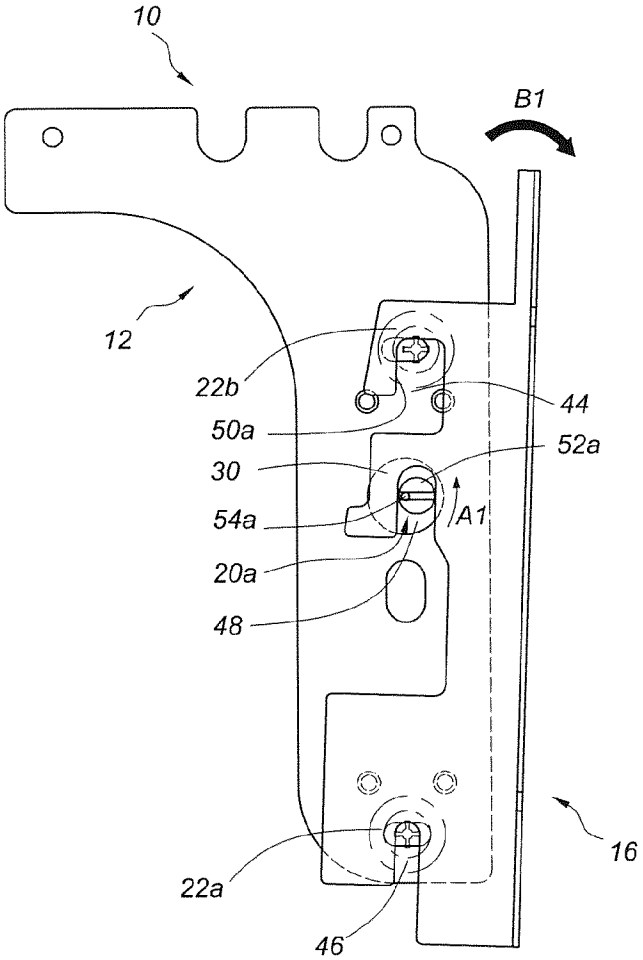
FIG. 5*a* is a schematic drawing in which the adjusting device in an embodiment of the present invention has been adjusted by a first angle.

Referring to FIG. 5*a*, the first adjusting member 20*a* generates an eccentric force with respect to the second plate 16 when rotationally displaced in a first direction A1 to a first predetermined position. This eccentric force drives the second plate 16 to displace about an axis defined by the first locking member 22*a*. More specifically, the second plate 16 is rotated by a first angle B1 with respect to the fixed member 12 while the first sidewall 50*a* of the connecting portion 44 of the second plate 16 is pressed against the second locking member 22*b*. Referring to FIG. 5*b*, the first adjusting member 20*a* generates another eccentric force with respect to the second plate 16 when rotationally displaced in a second direction A2 to a second predetermined position. This eccentric force also drives the second plate 16 to displace about the axis defined by the first locking member 22*a*, but in a different way. The second plate 16 is rotated by a second angle B2 with respect to the fixed member 12 while the second sidewall 50*b* of the connecting portion 44 of the second plate 16 is pressed against the second locking member 22*b*. In other words, the angle by which the second plate 16 is rotated with respect to the fixed member 12 can be adjusted by displacing the first adjusting member 20*a*. Therefore, the second plate 16 is angularly adjustable with respect to the fixed member 12.

Figure 6B:
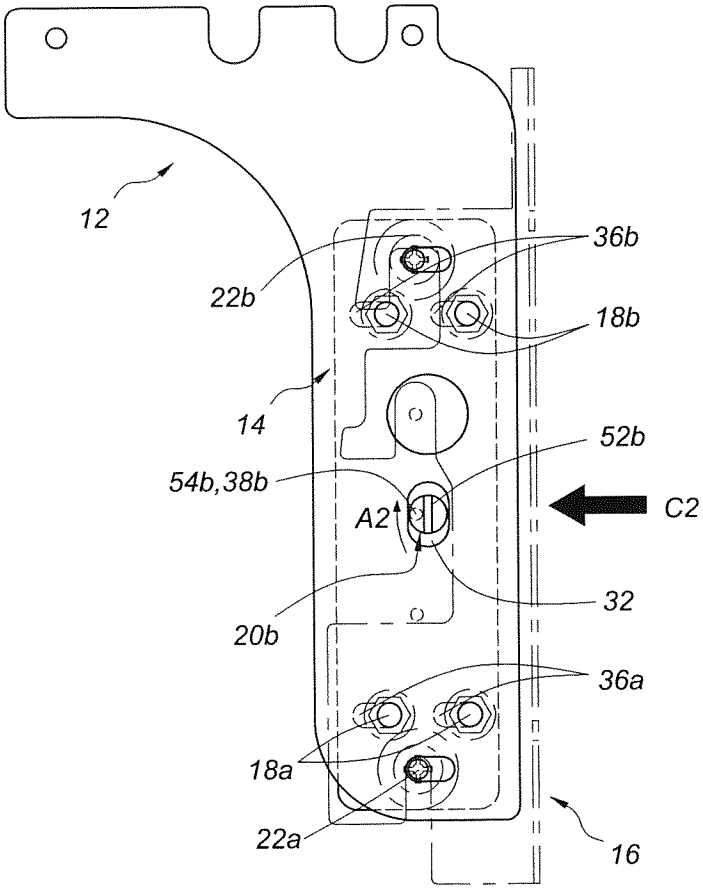
FIG. 6*b* is a schematic drawing in which the adjusting device in the embodiment in FIG. 6*a* has been adjusted to a second position.
Figure 6A:
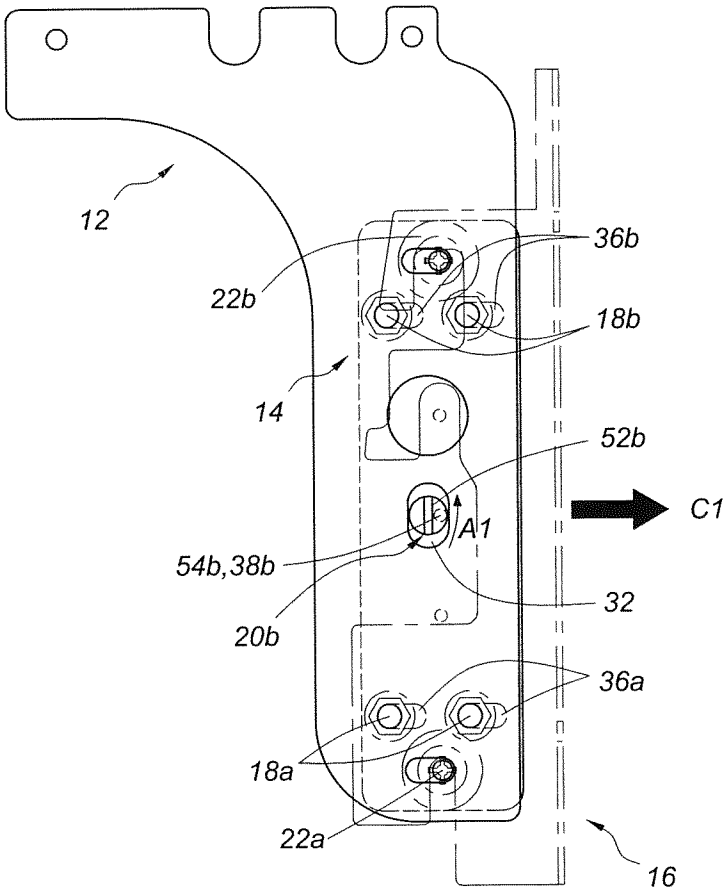
FIG. 6*a* is a schematic drawing in which the adjusting device in an embodiment of the present invention has been adjusted to a first position.

Referring to FIG. 6*a*, when the second adjusting member 20*b* is rotationally displaced in the first direction A1 to a first predetermined position, the first plate 14 is displaced relative to the fixed member 12 in response to the eccentric displacement of the second adjusting member 20*b* due to the fact that the adjusting portion 52*b* of the second adjusting member 20*b* contacts against the hole wall of the longitudinal hole 32 of the fixed member 12 and that the eccentric portion 54*b* of the second adjusting member 20*b* is movably connected to the second axial portion 38*b* of the first plate 14. As a result, the first locking member 22*a* and the second locking member 22*b* are driven to displace relative to the fixed member 12, and the second plate 16 is displaced relative to the fixed member 12 in response to the displacement of the first locking member 22*a*. Hence, by adjusting the second adjusting member 20*b*, the second plate 16 can be displaced to a first position C1 relative to the fixed member 12.

Similarly, referring to FIG. 6*b*, when the second adjusting member 20*b* is rotationally displaced in the second direction A2 to a second predetermined position, the first plate 14 is displaced relative to the fixed member 12 in response to the eccentric displacement of the second adjusting member 20*b*. Consequently, the first locking member 22*a* and the second locking member 22*b* are displaced relative to the fixed member 12, and the second plate 16 is displaced relative to the fixed member 12 in response to the displacement of the first locking member 22*a*. Therefore, by adjusting the second adjusting member 20*b*, the second plate 16 can be displaced to a second position C2 relative to the fixed member 12.

Figure 7:
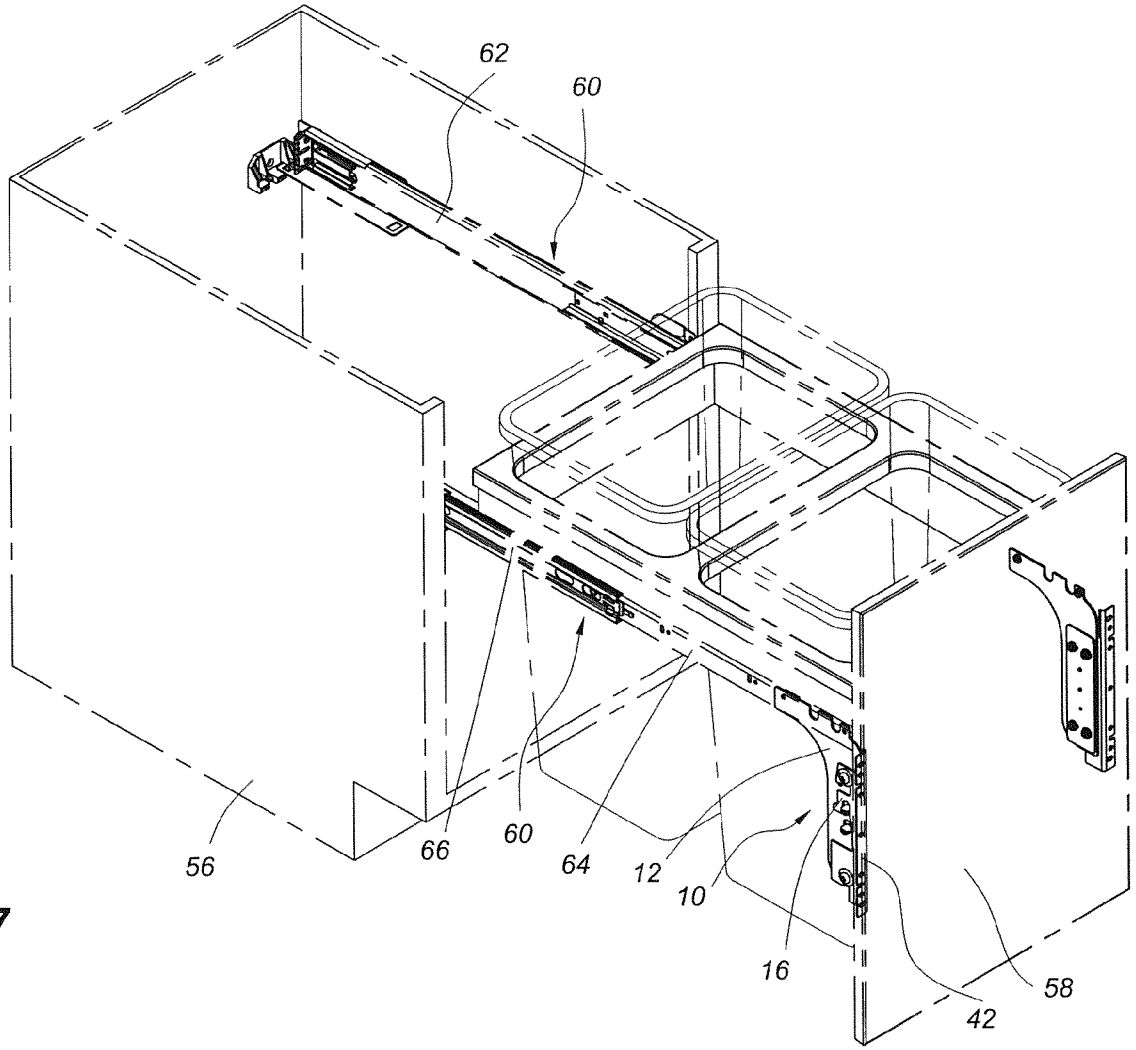
FIG. 7 is a perspective view showing how the adjusting device in an embodiment of the present invention is mounted to a furniture system.

FIG. 7 shows a drawer housing 56, a drawer face panel 58, and a slide rail assembly 60, in addition to the adjusting device 10. The slide rail assembly 60 is mounted between the drawer housing 56 and the adjusting device 10. The slide rail assembly 60 at least includes a fixed rail 62 and a movable rail 64 slidable relative to the fixed rail 62. Preferably, the slide rail assembly 60 further includes a middle rail 66 slidably connected between the fixed rail 62 and the movable rail 64 so that the movable rail 64 can be pulled out relative to the fixed rail 62 by a greater distance via the middle rail 66. In practice, the fixed rail 62 is fixedly mounted to the drawer housing 56, the fixed member 12 of the adjusting device 10 is fixedly mounted to the movable rail 64 of the slide rail assembly 60, and the drawer face panel 58 is mounted to the second plate section 42 of the second plate 16 of the adjusting device 10.

Figure 8C:
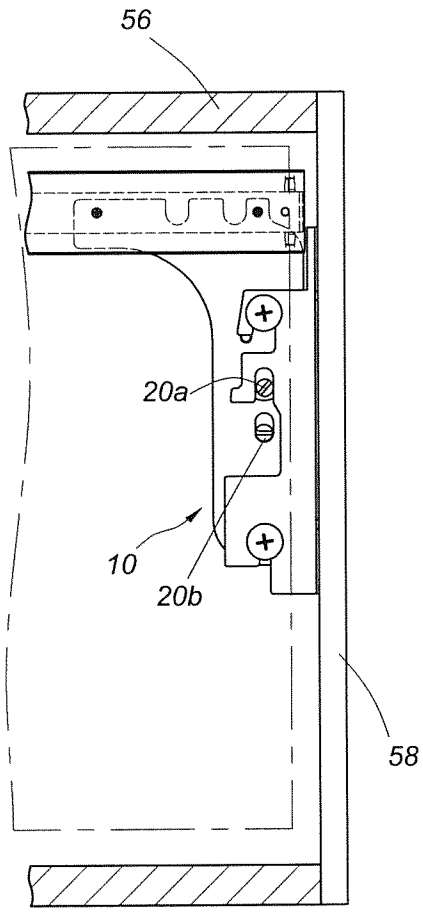
FIG. 8*c* is a schematic drawing in which the drawer face panel in the embodiment in FIG. 8*a* has been adjusted to a proper position.
Figure 8B:
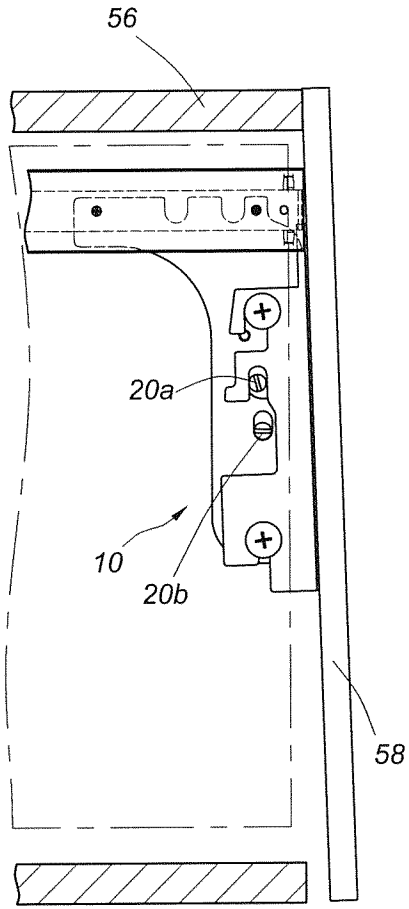
FIG. 8*b* is a schematic drawing in which the drawer face panel in the embodiment in FIG. 8*a* has been adjusted by the second angle.
Figure 8A:
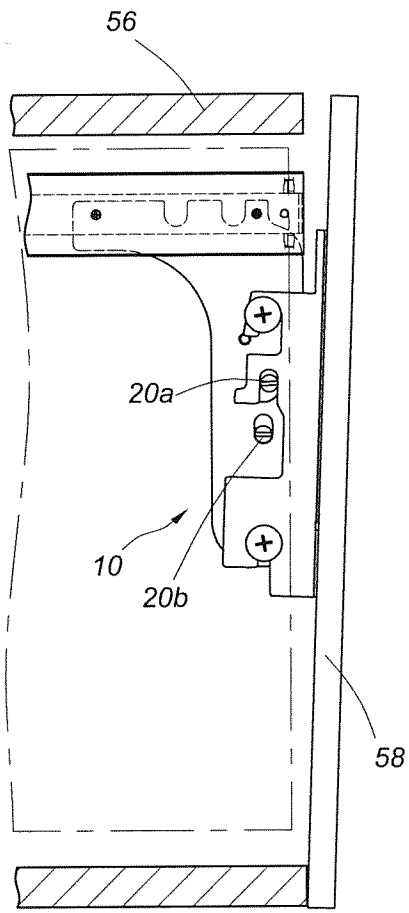
FIG. 8*a* is a schematic drawing in which the drawer face panel in an embodiment of the present invention has been adjusted by the first angle.

Referring to FIG. 8*a* and FIG. 8*b*, when the drawer face panel 58 is obliquely positioned relative to the drawer housing 56, the first adjusting member 20*a* and/or the second adjusting member 20*b* can be adjusted to bring the drawer face panel 58 to a proper position relative to the drawer housing 56, as shown in FIG. 8*c*.

While the present invention has been disclosed via the foregoing preferred embodiments, the embodiments are not intended to restrict the scope of the present invention. The scope of the present invention is defined by the appended claims.

The invention claimed is:

1. An adjusting device, comprising:

a first plate having a first axial portion;

a second plate having a first contact portion and a second contact portion;

a fixed member sandwiched between the first plate and the second plate, the fixed member having a first hole and a window, wherein the first hole is aligned with the first contact portion of the second plate, and the window is aligned with the first axial portion of the first plate and the second contact portion of the second plate;

a first adjusting member joining the first and second plates through the window of the fixed member, the first adjusting member including an adjusting portion and an eccentric portion protruding from the adjusting portion, wherein the adjusting portion of the first adjusting member contacts against an edge of the second contact portion of the second plate, and the eccentric portion of the first adjusting member is rotatably received in the first axial portion of the first plate; and a first locking member having a portion extending sequentially through the first contact portion of the second plate and the first hole of the fixed member and being secured to the first plate such that the second plate is able to swing, relative to the fixed member, about an axis defined by the first locking member in response to rotation of the first adjusting member;

wherein the second plate has a connecting portion aligned with a second hole formed on the fixed member, a second locking member has a portion extending sequentially through the connecting portion of the second plate and the second hole of the fixed member and being secured to the first plate, and the connecting portion has a first sidewall and a second sidewall which are spaced apart by a predetermined distance and between which the portion of the second locking member is located such that the second plate is allowed to swing relative to the fixed member within a range with the portion of the second locking member retained between the first sidewall and the second sidewall of the connecting portion of the second plate.

2. The adjusting device of claim 1, wherein the first adjusting member has a contour smaller than an edge of the window of the fixed member such that the first adjusting member extends through the window without contact with the edge of the window.

3. The adjusting device of claim 1, further comprising a second adjusting member extending through a longitudinal hole of the fixed member and a second axial portion of the first plate to join the fixed member and the first plate, the second adjusting member including an adjusting portion and an eccentric portion protruding from the adjusting portion, wherein the adjusting portion of the second adjusting member contacts against a hole wall of the longitudinal hole of the fixed member, and the eccentric portion of the second adjusting member is rotatably received in the second axial portion of the first plate such that the first plate and the fixed member are able to displace relative to each other in response to rotation of the second adjusting member.

4. The adjusting device of claim 3, wherein the first hole of the fixed member is a transverse slot by which a relative displacement between the first plate and the fixed member is restricted in a transverse direction.

5. The adjusting device of claim 4, wherein the portion of the first locking member is located adjacent to an edge of the first contact portion of the second plate such that the second plate is displaced, together with the first plate, relative to the fixed member in the transverse direction as the edge of the first contact portion of the second plate is pushed against the portion of the first locking member.

6. The adjusting device of claim 1, wherein the second hole of the fixed member has a first width and a first height, and the connecting portion of the second plate has a second width and a second height, the first width of the second hole being greater than or equal to the second width of the connecting portion, the first height of the second hole being greater than the second height of the connecting portion.

7. A furniture system, comprising:

a drawer housing;

a drawer face panel;

a slide rail assembly including a fixed rail and a movable rail slidably connected to the fixed rail, the fixed rail being fixedly mounted to the drawer housing; and an adjusting device according to claim 1, wherein the second plate of the adjusting device includes a first plate section and a second plate section substantially perpendicularly extending from the first plate section, the first plate section is formed with the first contact portion and the second contact portion, and the second plate section is mounted to the drawer face panel; and wherein the fixed member of the adjusting device is mounted to the movable rail of the slide rail assembly.

8. The furniture system of claim 7, wherein the first adjusting member of the adjusting device has a contour smaller than an edge of the window of the fixed member such that the first adjusting member extends through the window without contact with the edge of the window.

9. The furniture system of claim 7, wherein the second plate of the adjusting device has a connecting portion aligned with a second hole formed on the fixed member, a second locking member has a portion extending sequentially through the connecting portion of the second plate and the second hole of the fixed member and being secured to the first plate, and the connecting portion has a first sidewall and a second sidewall which are spaced apart by a predetermined distance and between which the portion of the second locking member is located such that the second plate is allowed to swing relative to the fixed member within a range with the portion of the second locking member retained between the first sidewall and the second sidewall of the connecting portion of the second plate.

10. The furniture system of claim 7, wherein the adjusting device further comprises a second adjusting member extending through a longitudinal hole of the fixed member and a second axial portion of the first plate to join the fixed member and the first plate, the second adjusting member including an adjusting portion and an eccentric portion protruding from the adjusting portion, and wherein the adjusting portion of the second adjusting member contacts against a hole wall of the longitudinal hole of the fixed member, and the eccentric portion of the second adjusting member is rotatably received in the second axial portion of the first plate such that the first plate and the fixed member are able to displace relative to each other in response to rotation of the second adjusting member.

11. The furniture system of claim 10, wherein the first hole of the fixed member of the adjusting device is a transverse slot by which a relative displacement between the first plate and the fixed member is restricted in a transverse direction.

12. The furniture system of claim 11, wherein the portion of the first locking member of the adjusting device is located adjacent to an edge of the first contact portion of the second plate such that the second plate is displaced, together with the first plate, relative to the fixed member in the transverse direction as the edge of the first contact portion of the second plate is pushed against the portion of the first locking member.

13. The furniture system of claim 7, wherein the second hole of the fixed member of the adjusting device has a first width and a first height, and the connecting portion of the second plate of the adjusting device has a second width and a second height, the first width of the second hole being greater than or equal to the second width of the connecting portion, the first height of the second hole being greater than the second height of the connecting portion.

14. An adjusting device, comprising:

a first plate having a first axial portion;

a second plate having a first contact portion and a second contact portion;

a fixed member sandwiched between the first plate and the second plate, the fixed member having a first hole and a window, wherein the first hole is aligned with the first contact portion of the second plate, and the window is aligned with the first axial portion of the first plate and the second contact portion of the second plate;

a first adjusting member joining the first and second plates through the window of the fixed member, the first adjusting member including an adjusting portion and an eccentric portion protruding from the adjusting portion, wherein the adjusting portion of the first adjusting member contacts against an edge of the second contact portion of the second plate, and the eccentric portion of the first adjusting member is rotatably received in the first axial portion of the first plate; and a first locking member having a portion extending sequentially through the first contact portion of the second plate and the first hole of the fixed member and being secured to the first plate such that the second plate is able to swing, relative to the fixed member, about an axis defined by the first locking member in response to rotation of the first adjusting member;

wherein the first adjusting member has a contour smaller than an edge of the window of the fixed member such that the first adjusting member extends through the window without contact with the edge of the window.

15. The adjusting device of claim 14, further comprising a second adjusting member extending through a longitudinal hole of the fixed member and a second axial portion of the first plate to join the fixed member and the first plate, the second adjusting member including an adjusting portion and an eccentric portion protruding from the adjusting portion, wherein the adjusting portion of the second adjusting member contacts against a hole wall of the longitudinal hole of the fixed member, and the eccentric portion of the second adjusting member is rotatably received in the second axial portion of the first plate such that the first plate and the fixed member are able to displace relative to each other in response to rotation of the second adjusting member.

16. The adjusting device of claim 15, wherein the first hole of the fixed member is a transverse slot by which a relative displacement between the first plate and the fixed member is restricted in a transverse direction.

17. The adjusting device of claim 16, wherein the portion of the first locking member is located adjacent to an edge of the first contact portion of the second plate such that the second plate is displaced, together with the first plate, relative to the fixed member in the transverse direction as the edge of the first contact portion of the second plate is pushed against the portion of the first locking member.

18. The adjusting device of claim 14, wherein the second plate has a connecting portion aligned with a second hole formed on the fixed member, the second hole of the fixed member has a first width and a first height, and the connecting portion of the second plate has a second width and a second height, the first width of the second hole being greater than or equal to the second width of the connecting portion, the first height of the second hole being greater than the second height of the connecting portion.

* * * * *